US006814471B1

(12) United States Patent
Stoner

(10) Patent No.: US 6,814,471 B1
(45) Date of Patent: Nov. 9, 2004

(54) ADAPTER FOR DECORATIVE LIGHTING FIXTURE

(76) Inventor: Douglas Stoner, 210 Kathleen Way, Glenmoore, PA (US) 19343

( * ) Notice: Subject to any disclaimer, the term of this patent is extended or adjusted under 35 U.S.C. 154(b) by 62 days.

(21) Appl. No.: 10/388,041

(22) Filed: Mar. 13, 2003

(51) Int. Cl.[7] ..... F21V 17/10
(52) U.S. Cl. ..... 362/364; 362/147; 362/454
(58) Field of Search ..... 362/364, 365, 362/368, 370, 147, 148, 150, 404, 408, 451, 453, 454, 456

(56) References Cited

U.S. PATENT DOCUMENTS

| | | | | |
|---|---|---|---|---|
| 2,741,695 | A | | 4/1956 | Schockett |
| 2,972,676 | A | | 2/1961 | Moser |
| 3,012,135 | A | | 12/1961 | Kurtzon |
| 3,044,106 | A | | 7/1962 | Papsdorf |
| 3,158,329 | A | | 11/1964 | Wince |
| 3,518,420 | A | | 6/1970 | Kripp |
| D319,110 | S | | 8/1991 | Tatosian |
| 5,128,850 | A | | 7/1992 | Juodvalkis |
| 5,130,915 | A | | 7/1992 | Lerch |
| D331,638 | S | | 12/1992 | Vamberszky et al. |
| D341,442 | S | | 11/1993 | Shapiro |
| D347,293 | S | | 5/1994 | Roos et al. |
| 5,404,284 | A | * | 4/1995 | Davis, Jr. ..... 362/294 |
| D382,663 | S | | 8/1997 | Barry |
| 5,772,314 | A | | 6/1998 | Brumer |
| 5,826,970 | A | | 10/1998 | Keller et al. |
| 6,030,102 | A | | 2/2000 | Gromotka |
| 6,095,669 | A | | 8/2000 | Cho |
| 6,164,802 | A | | 12/2000 | Gromotka |
| 6,168,298 | B1 | | 1/2001 | Hentz et al. |
| D438,328 | S | | 2/2001 | Pan |
| D444,588 | S | | 7/2001 | Lin |
| D444,900 | S | | 7/2001 | Stanway et al. |
| 6,364,511 | B1 | | 4/2002 | Cohen |
| 6,457,848 | B1 | * | 10/2002 | Wolf et al. ..... 362/364 |
| 6,474,846 | B1 | * | 11/2002 | Kelmelis et al. ..... 362/365 |

* cited by examiner

*Primary Examiner*—Alan Cariaso
*Assistant Examiner*—Mark Tsidulko
(74) *Attorney, Agent, or Firm*—Norman E. Lehrer

(57) ABSTRACT

An adapter for a decorative lighting fixture for recessed lighting is disclosed. The adapter includes a generally circular rim and a plurality of arms extending from the periphery of the rim into the center of the rim. The arms meet at a junction at the center of the rim. The rim is releasably secured to a ceiling surrounding the recessed lighting and a decorative lighting fixture or lens may be secured to the rim. The rim may be secured to the ceiling via screws. Likewise, the decorative lighting fixture may be secured to the rim by a bolt.

4 Claims, 3 Drawing Sheets

ADAPTER FOR DECORATIVE LIGHTING FIXTURE

BACKGROUND OF THE INVENTION

The present invention is directed toward an adapter for a decorative lighting fixture and more particularly, toward an adapter that allows a decorative fixture to be used in conjunction with recessed lighting.

It is well known to provide decorative fixtures or covers for various types of ceiling mounted lighting. These fixtures provide various types of aesthetically pleasing light transmissions. Typically, however, these fixtures are mounted directly to the lighting. For example, U.S. Des. Pat. No. 341,442 to Shapiro and U.S. Des. Pat. No. 331,638 to Vamberszky et al disclose decorative covers mounted directly to the lighting fixture.

Other covers may not be mounted directly to the lighting, but are more elaborate and are not easily replaced. See, for example, U.S. Pat. No. 5,128,850 to Juodvalkis. This patent discloses a decorative cover a ceiling mounted light that attached directly to the ceiling. However, this cover does not appear to be easily removed and replaced.

Still other covers can be costly to purchase and burdensome to install and maintain. For example, U.S. Pat. No. 5,772,314 to Brumer discloses a frame that may be secured to a ceiling surrounding a light. A decorative fixture may be attached to the frame. However, this device appears to be rather complicated and does not appear to be easy to install.

A need remains, therefore, for an inexpensive and simple way to install a decorative fixture for ceiling mounted lighting that is removably mounted over the recessed ceiling mounted light.

SUMMARY OF THE INVENTION

The present invention is designed to overcome the deficiencies of the prior art discussed above. It is an object of the present invention to provide an adapter for a decorative lighting fixture that allows a decorative fixture to be used with recessed lighting.

It is another object of the present invention to provide an adapter for a decorative lighting fixture that is easy to install and use.

It is a further object of the present invention to provide a structure that is not mounted to the recessed lighting fixture.

In accordance with the illustrative embodiments demonstrating features and advantages of the present invention, there is provided an adapter for a decorative lighting fixture for recessed lighting that includes a generally circular rim and a plurality of arms extending from the periphery of the rim into the center of the rim. The arms meet at a junction at the center of the rim. The rim is releasably secured directly to the ceiling surrounding the recessed lighting and a decorative lighting fixture or lens may be secured to the rim. The rim may be secured to the ceiling via screws, molly bolts or similar anchors. Likewise, the decorative lighting fixture may be secured to the rim by a bolt.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 3:
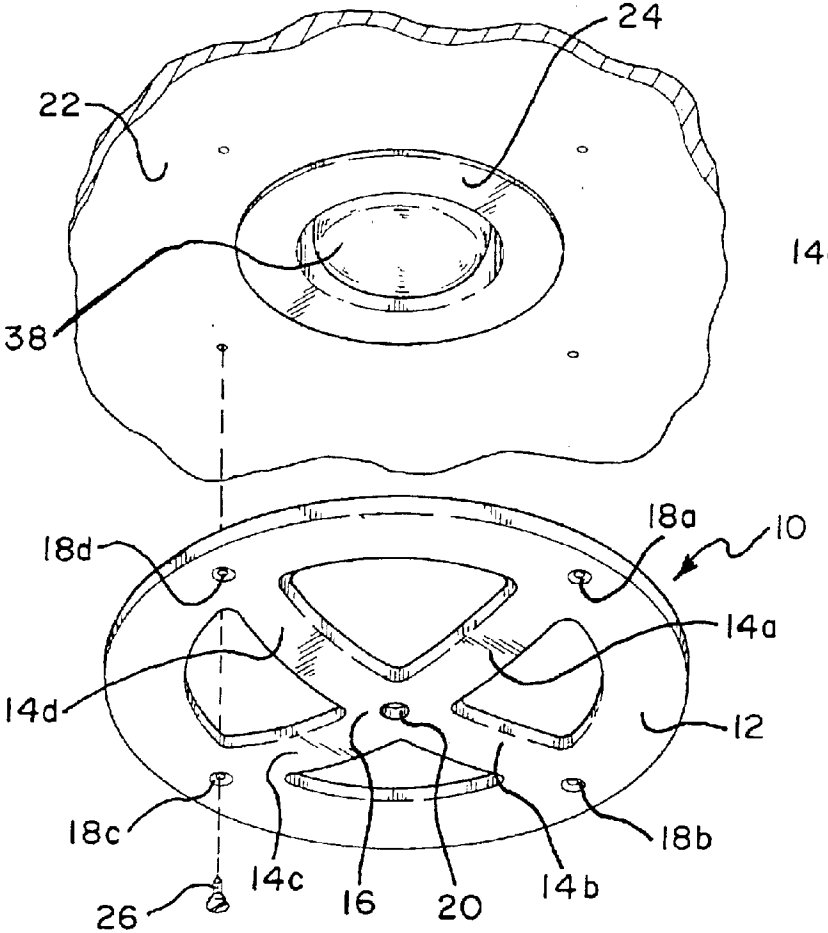
FIG. 3 is an exploded view of the adapter of the present invention being mounted to a ceiling.

Referring now to the drawings in detail wherein like reference numerals have been used throughout the various figures to designate like elements, there is shown in FIG. 3 an adapter for a decorative lighting fixture constructed in accordance with the principles of the present invention and designated generally as 10.

The adapter 10 of the present invention essentially includes a ring-like, generally circular structure in the form of a rim 12 that may be made of plastic, metal or other suitable material. A plurality of arms 14*a*, 14*b*, 14*c*, and 14*d* are attached to the periphery of the rim 12 and extend into the center of the structure. The arms 14*a*, 14*b*, 14*c*, and 14*d* meet at a junction 16 located near the center of the structure. (See FIG. 3.)

Located along the rim are a plurality of apertures 18*a*, 18*b*, 18*c*, and 18*d*. Although four such apertures are shown, more or fewer may be utilized, depending on the weight of the fixture. Another aperture 20 is located in the center at the junction 16 of the arms 14*a*, 14*b*, 14*c*, and 14*d*. (See FIG. 3.) The purpose of the apertures will be discussed in greater detail below.

Figure 2:
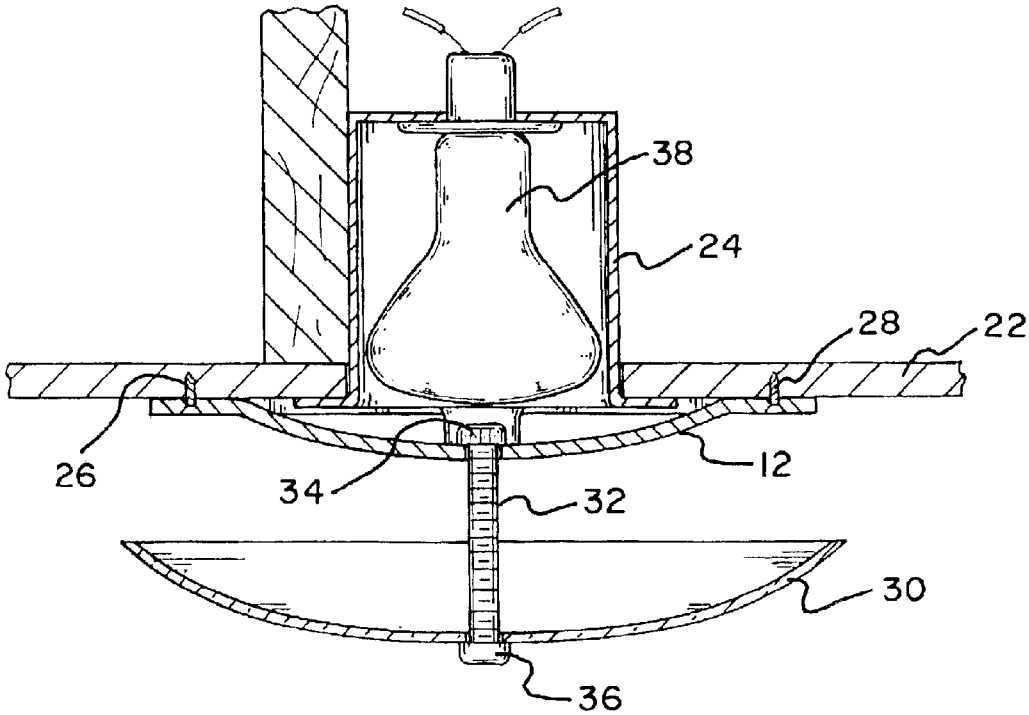
FIG. 2 is a cross-sectional view taken through line 2—2 of FIG. 1.

In order to use the structure of the present invention, the rim 12 may be screwed or otherwise removably mounted to the ceiling 22 surrounding a recessed lighting socket or fixture 24. For example, screws or bolts, shown as 26 and 28, may be screwed through the apertures located along the periphery of the rim 12 and into the ceiling 22. (See FIG. 2.) As should be readily apparent to those skilled in the art, because the rim is being secured directly to the ceiling, it can be used with essentially any size recessed light fixture. The only requirement being that the rim 12 must be larger in diameter than the fixture so as to fit around the same. Furthermore, since the screws 26 or 28 are being screwed directly into the ceiling, the orientation of the rim is not important. That is, it can be rotated as desired. In fact, the rim and light fixture need not be exactly concentric for the invention to function properly. All of the forgoing makes the installation of the invention quick and easy by even an unskilled person.

Figure 1:
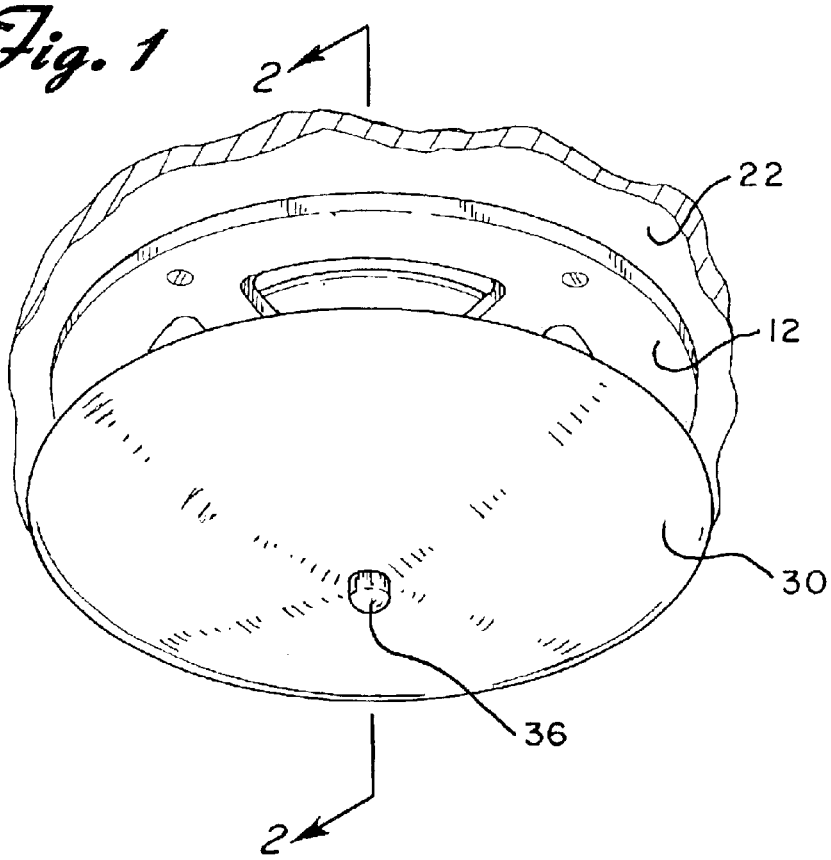
FIG. 1 is a bottom perspective view of the adapter of the present invention installed on a ceiling.
Figure 4:
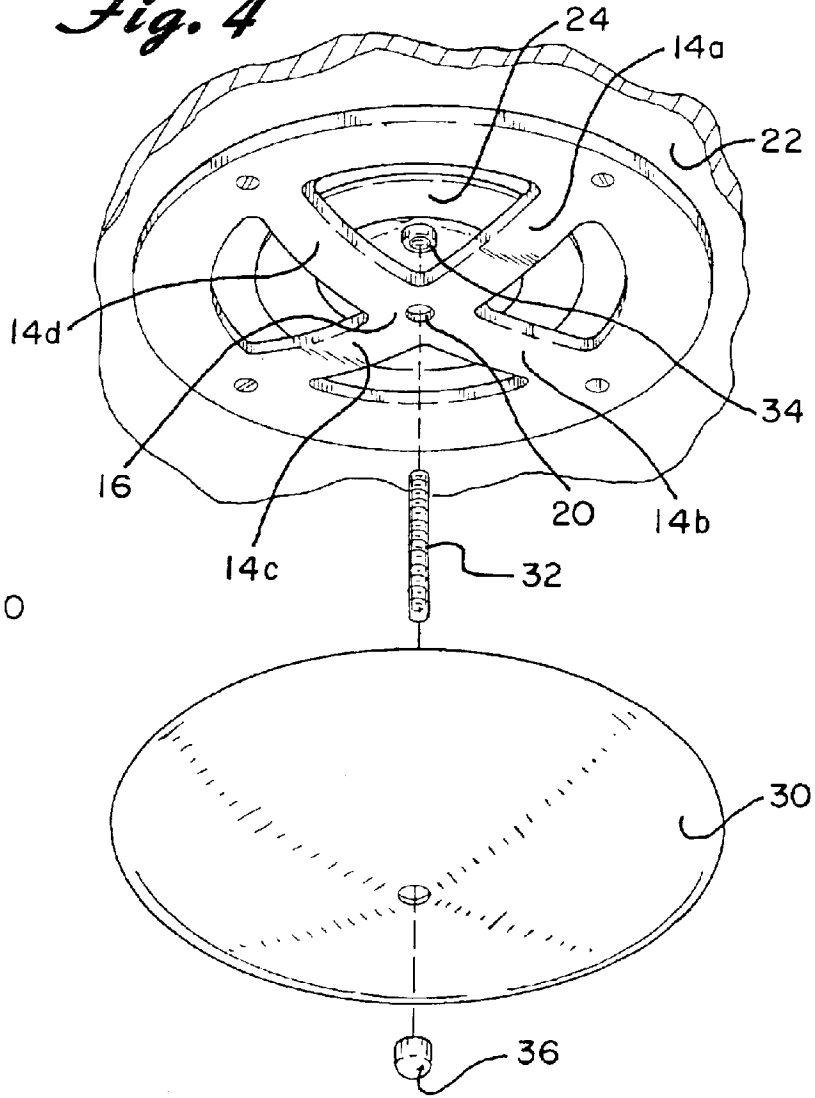
FIG. 4 is an exploded view of the adapter of the present invention mounted to a ceiling and a decorative lens being mounted thereto.

A decorative fixture 30, such as a dome, diffuser, lens, or other such fixture, is then mounted to the rim 12 via bolt 32 being screwed through central aperture 20 of the rim 12. (See FIG. 4.) End caps 34 and 36 are secured to the ends of the bolt 32. In this manner, the decorative light fixture 30 is removably mounted to the adapter which surrounds a typical recessed lighting fixture 24. (See FIG. 1.) The light from light bulb 38 is filtered through the lens 30 in the known manner. (See FIG. 2.) The decorative light fixture may be of any type of decorative design, such as a parabolic or dome-shaped lens. The light fixture will, however, substantially cover the rim and recessed lighting.

Figure 6:
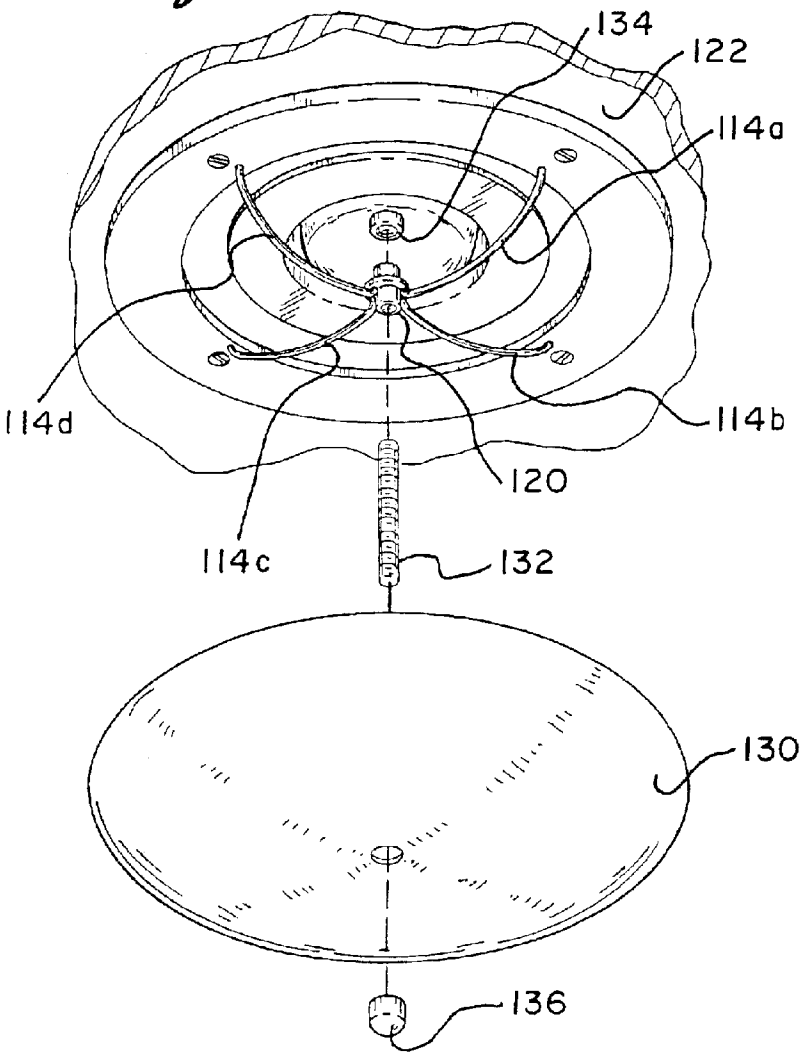
FIG. 6 is an exploded view, similar to FIG. 4, of the second embodiment of the adapter of the present invention mounted to a ceiling and a decorative lens being mounted thereto.
Figure 5:
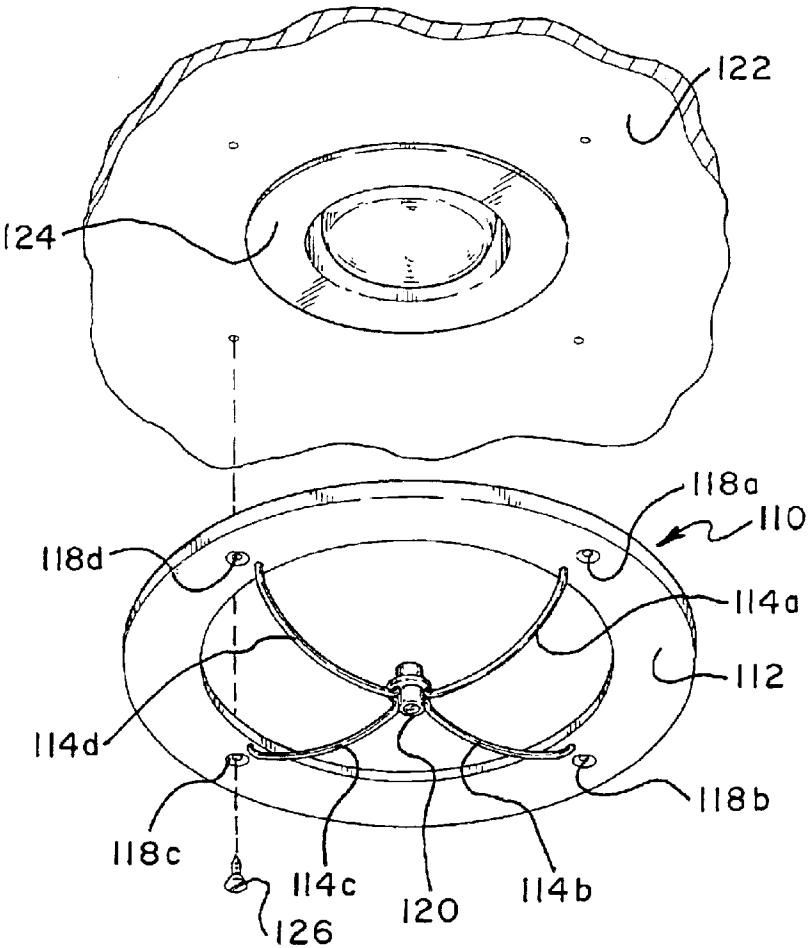
FIG. 5 is an exploded view, similar to FIG. 3, of a second embodiment of the adapter of the present invention.

A second embodiment of the present invention is shown in FIGS. 5 and 6. As in the first embodiment, the adapter 110 essentially includes a ring-like, generally circular structure in the form of a rim 112 that may be made of plastic, metal or other suitable material. A plurality of arms 114*a*, 114*b*, 114*c*, and 114*d*, which may be made from wire or the like, are removably secured or attached to the rim 112 and extend into the center of the structure. The arms 114*a*, 114*b*, 114*c*, and 114*d* meet at a junction located near the center of the structure.

Located along the rim are a plurality of apertures 118*a*, 118*b*, 118*c*, and 118*d*. Although four such apertures are shown, more or fewer may be utilized, depending on the weight of the fixture. Another aperture 120 is located in the center at the junction of the arms 114*a*, 114*b*, 114*c*, and 114*d*. The purpose of the apertures will be discussed in greater detail below.

The use of the device as described in the first embodiment is the same in the second embodiment with the differences discussed below. The rim 112 may be screwed or otherwise removably mounted to the ceiling 122 surrounding a recessed lighting socket or fixture 124. For example, screws or bolts, shown as 126 may be screwed through the apertures located along the periphery of the rim 112 and into the ceiling 122.

As is the first embodiment, because the rim is being secured directly to the ceiling, it can be used with essentially any size recessed light fixture. The only requirement being that the rim must be larger in diameter than the fixture so as to fit around the same. Furthermore, because the screws are being screwed directly into the ceiling, the orientation of the rim is not important. That is, it can be rotated as desired. In fact, the rim and light fixture need not be exactly concentric for the invention to function properly. All of the forgoing makes the installation of the invention quick and easy by even an unskilled person.

A decorative fixture 130, such as a dome, diffuser, lens, or other such fixture, is then mounted to the rim 112 via bolt 132 being screwed through central aperture 120. End caps 134 and 136 are secured to the ends of the bolt 132. In this manner, the decorative light fixture 130 is removably mounted to the adapter which surrounds a typical recessed lighting fixture 124. In this embodiment, the arms 114*a*–114*d* are flexible making it possible to replace a light bulb without having to remove the arms or the rim from the ceiling.

The present invention may be embodied in other specific forms without departing from the spirit or essential attributes thereof and accordingly, reference should be made to the appended claims rather than to the foregoing specification as indicating the scope of the invention.

I claim:

1. An adapter for a decorative lighting fixture for recessed lighting comprising:

a generally circular rim;

a plurality of arms extending from the periphery of said rim into the center of said rim, said arms meeting at a junction at the center of said rim;

means for releasably securing said rim to a ceiling surrounding the recessed lighting; and means for securing a decorative lighting fixture to said rim.

2. The adapter for a decorative lighting fixture of claim 1 wherein said means for releasably securing said rim to the ceiling includes a plurality of screws and apertures formed in the periphery of said rim through which said screws are inserted and secured.

3. The adapter for a decorative lighting fixture of claim 1 wherein said means for securing said decorative lighting fixture to said rim includes a bolt and an aperture located at said junction, said bolt extending through said aperture.

4. The adapter for a decorative lighting fixture of claim 1 wherein said plurality of arms are removably attached to said rim.

* * * * *